US005400681A

United States Patent [19]

Strauch

[11] Patent Number: 5,400,681

[45] Date of Patent: Mar. 28, 1995

[54] SCREW DRIVING EXTENSION APPARATUS

[76] Inventor: Melvin D. Strauch, 3242 St. Johns Ave., Billings, Mont. 59102

[21] Appl. No.: 120,066

[22] Filed: Sep. 13, 1993

[51] Int. Cl.[6] ..... B25B 23/16

[52] U.S. Cl. ..... 81/177.2; 81/451; 81/476

[58] Field of Search ..... 81/124.7, 177.1, 177.2, 81/451, 476

[56] References Cited

U.S. PATENT DOCUMENTS

| | | | |
|---|---|---|---|
| 956,467 | 4/1910 | Anderson | 81/124.7 X |
| 3,208,316 | 9/1965 | Scribner | 81/476 |
| 3,392,767 | 7/1968 | Stillwagon | 81/451 |
| 4,140,161 | 2/1979 | Russo | 81/451 |

*Primary Examiner*—James G. Smith
*Attorney, Agent, or Firm*—E. Michael Combs

[57] ABSTRACT

An elongate tubular housing includes a housing first end spaced from a housing second end coaxially aligned to mount rotatably a shaft, wherein the shaft is arranged for projection through the first end, with the shaft having a screw driver bit driver at the shaft second end recessed below the housing second end in a first position, wherein the shaft is arranged for reciprocation within the shaft for projection therefrom to extend the shaft in a screw driving procedure, with the shaft including a handle for manually securing the shaft during a driving procedure.

4 Claims, 4 Drawing Sheets

FIG. 1
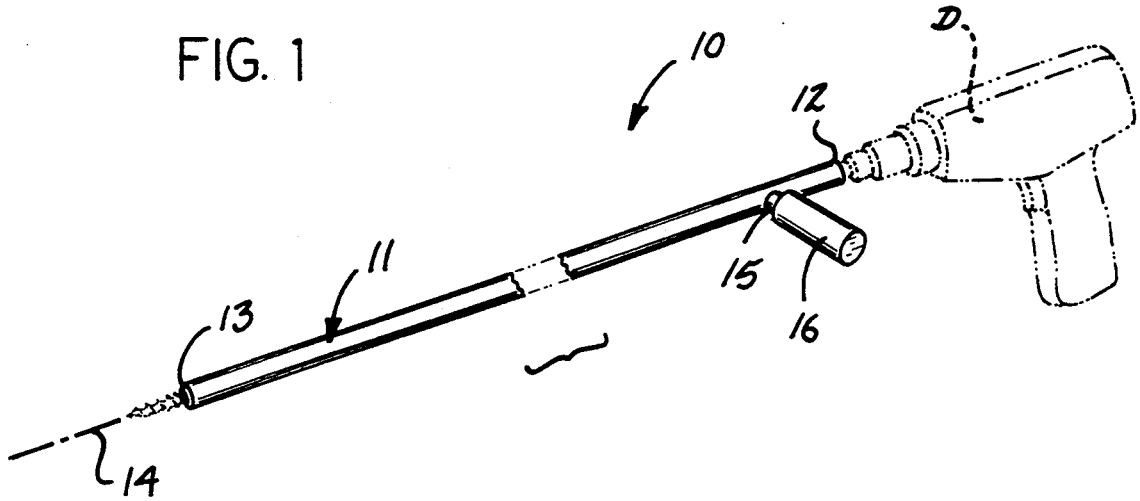
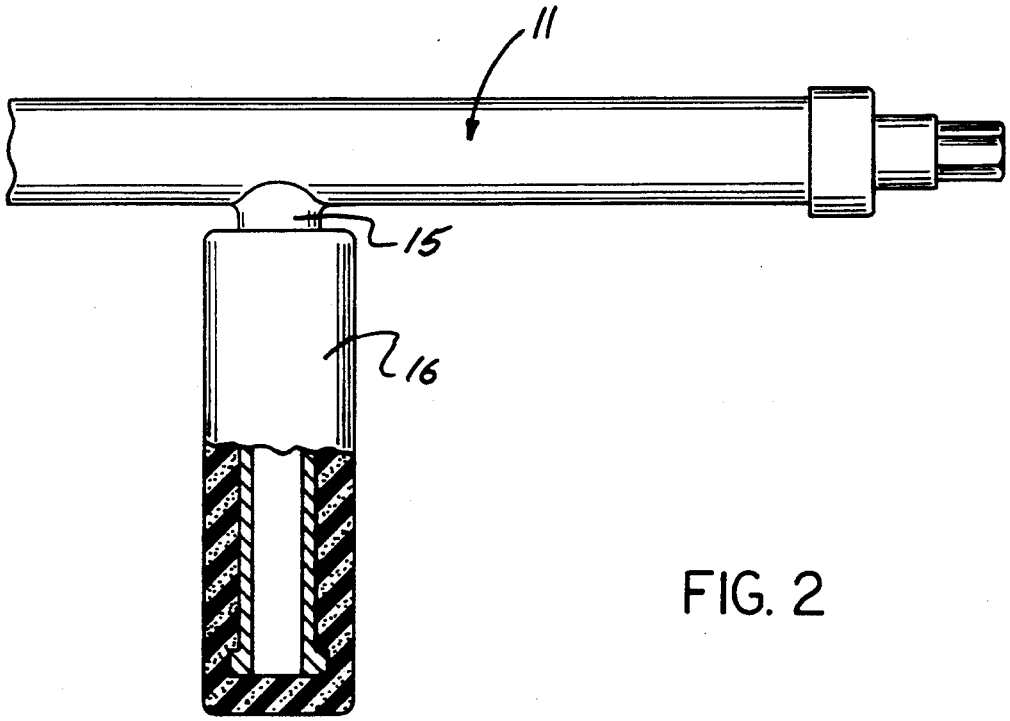
FIG. 2

SCREW DRIVING EXTENSION APPARATUS

BACKGROUND OF THE INVENTION

1. Field of the Invention

The field of invention relates to screw driving apparatus, and more particularly pertains to a new and improved screw driving extension apparatus wherein the same is arranged for receiving and driving fastener screws remotely from a driver such as a drill and the like.

2. Description of the Prior Art

Screw driver structure and screw driver extension is available in the prior art, wherein U.S. Pat. No. 4,076,444 indicates a prior art example of a screw driver extension shaft arranged to secure a drill bit at a remote orientation relative to a driving tool.

The instant invention attempts to overcome deficiencies of the prior art by providing for an extension structure arranged to reciprocatably mount a shaft arranged to permit extension and projection of the shaft during driving of a fastener from within the shaft structure and in this respect, the present invention substantially fulfills this need.

SUMMARY OF THE INVENTION

In view of the foregoing disadvantages inherent in the known types of screw driver apparatus now present in the prior art, the present invention provides a screw driving extension apparatus wherein the same includes a rotary shaft reciprocatably and rotatably mounted within an elongate housing. As such, the general purpose of the present invention, which will be described subsequently in greater detail, is to provide a new and improved screw driving extension apparatus which has all the advantages of the prior art screw driving extension apparatus and none of the disadvantages.

To attain this, the present invention provides an elongate tubular housing including a housing first end spaced from a housing second end coaxially aligned to mount rotatably a shaft, wherein the shaft is arranged for projection through the first end, with the shaft having a screw driver bit driver at the shaft second end recessed below the housing second end in a first position, wherein the shaft is arranged for reciprocation within the shaft for projection therefrom to extend the shaft in a screw driving procedure, with the shaft including a handle for manually securing the shaft during a driving procedure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved screw driving extension apparatus which has all the advantages of the prior art screw driving extension apparatus and none of the disadvantages.

It is another object of the present invention to provide a new and improved screw driving extension apparatus which may be easily and efficiently manufactured and marketed.

It is a further object of the present invention to provide a new and improved screw driving extension apparatus which is of a durable and reliable construction.

An even further object of the present invention is to provide a new and improved screw driving extension apparatus which is susceptible of a low cost of manufacture with regard to both materials and labor, and which accordingly is then susceptible of low prices of sale to the consuming public, thereby making such screw driving extension apparatus economically available to the buying public.

Still yet another object of the present invention is to provide a new and improved screw driving extension apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof, Such description makes reference to the annexed drawings wherein:

FIG. 1 is an isometric illustration of the invention.

FIG. 2 is an enlarged orthographic view, partially in section, of the housing and handle structure.

DESCRIPTION OF THE PREFERRED EMBODIMENT

Figure 3:
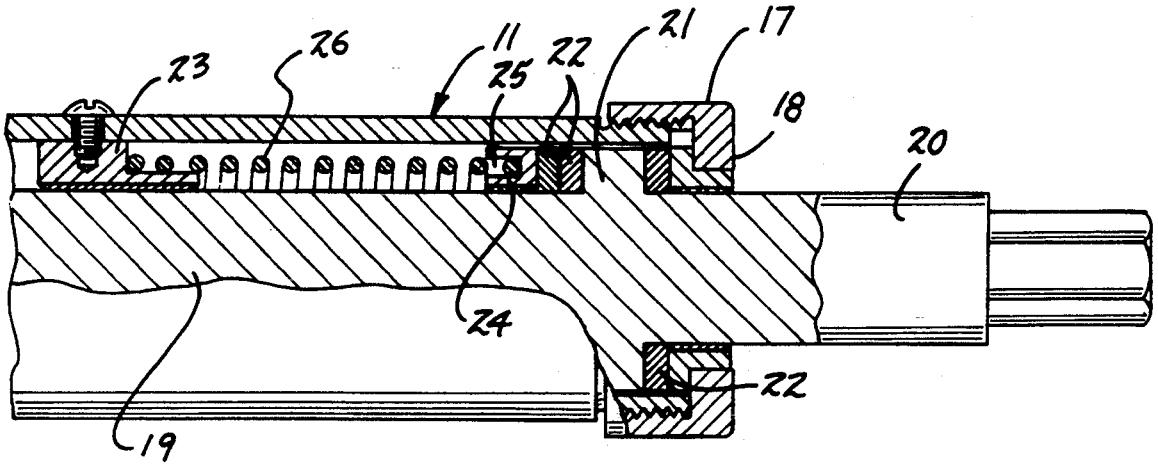
FIG. 3 is an enlarged orthographic view, partially in section, of the first end of the housing and shaft structure.

With reference now to the drawings, and in particular to FIGS. 1 to 8 thereof, a new and improved screw driving extension apparatus embodying the principles and concepts of the present invention and generally designated by the reference numeral 10 will be described.

More specifically, the screw driving extension apparatus 10 of the instant invention essentially comprises an elongate tubular housing 11, having a housing first end 12 spaced from a housing second end 13 coaxially aligned about an axis 14, with a tubular handle 15 fixedly mounted to the tubular housing 11 between the housing first and second ends 12 and 13 for manual grasping of the organization to maintain the tubular housing 11 in a stationary orientation relative to an internal rotary shaft 19 rotatably mounted coaxially of the housing 11. The handle includes a handle covering sheath 16 for ease of manual grasping of the handle structure 15.

Figure 4:
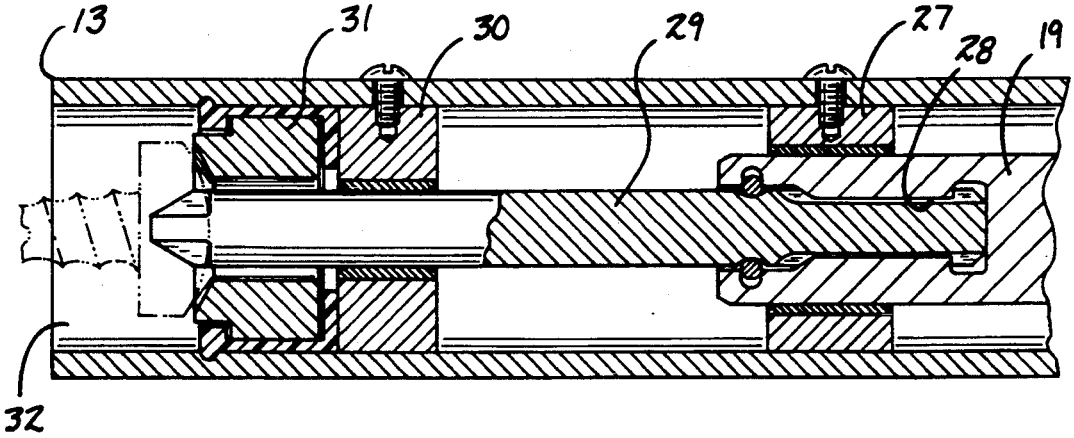
FIG. 4 is an enlarged orthographic view in cross-section of the second end of the housing and shaft structure.

The first end 12 includes a first end cap 17 mounted thereon, having a cap annular flange 18, having a through-extending cap bore to rotatably and slidably receive the rotary shaft 19 therethrough. The rotary shaft 19 includes a shaft first end 20 projecting through and beyond the first end cap 17 relative to the housing 11, with the shaft 19 having a shaft second end including a polygonal socket 28, of a type as indicated in FIG. 4, to receive a longitudinal screw driver bit 29 therewithin coaxially aligned along the axis 14. The shaft 19 includes a shaft annular flange 21 fixedly mounted to the shaft extending radially therebeyond, having bearing plates 22 mounted upon opposed sides of the annular flange 21 to enhance ease of rotation of the shaft, with the annular flange arranged for relative rotative mounting relative and in abutment with the cap annular flange 18. A fixed first annular bushing 23 is mounted within the housing between the housing and the shaft 19 spaced from the housing first end, with a reciprocatably mounted second annular bushing 24 having an annular slot 25 therewithin and captures a spring 26 between the second bushing 24 and the first bushing 23, wherein the second bushing is arranged for abutment to one of the bearing plates 22 between the shaft annular flange 21 and the first bushing 23. A fixed third annular bushing 27 is spaced from the first annular bushing on an opposed side of the first annular bushing relative to the second annular bushing, with a fixed fourth annular bushing 30 spaced from the fixed third annular bushing 27, with the fourth fixed annular bushing 30 positioned in spaced adjacency relative to the housing second end, with a ferromagnetic collar 31 mounted between the fourth bushing 30 and the housing second end, with the magnetic collar 31 including a magnetic collar central bore arranged to slidably receive the screw driving bit 29 therethrough to enhance mounting of a fastener, of a type as indicated in phantom in FIG. 4.

In this manner, a fastener is positioned upon the screw driving bit 29, whereupon projection of the shaft and compression of the spring 26 projects the fastener beyond the housing second end to direct a fastener, in a manner as indicated in FIG. 1, within a swivel workpiece. The fastener in this manner is received within a fastener receiving cavity 32 between the magnetic collar 31 and the housing second end 13.

Figure 5:
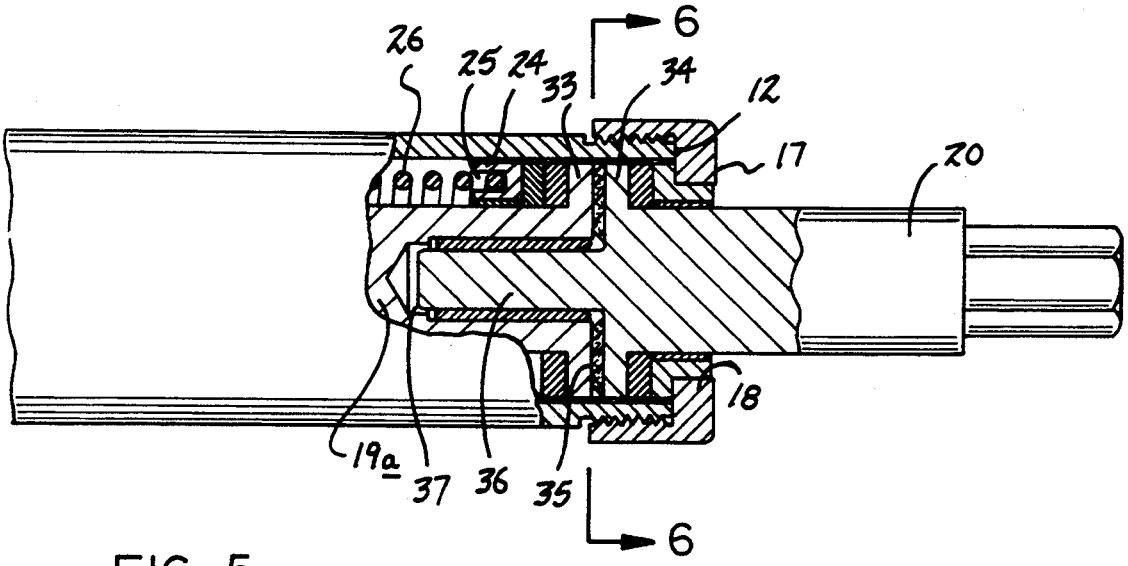
FIG. 5 is an orthographic view, partially in section, of a modified shaft structure, including a clutching structure limiting torque application to the shaft.
Figure 6:
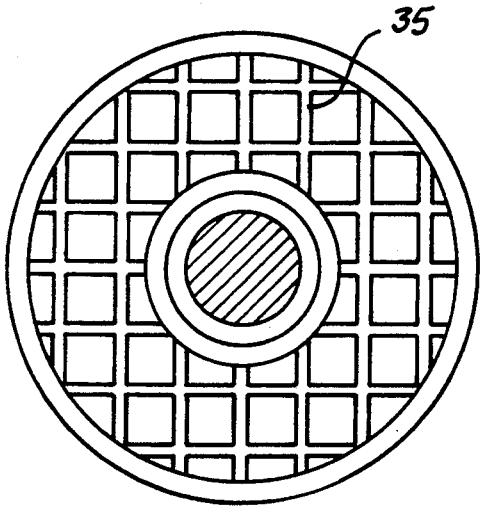
FIG. 6 is an orthographic view, taken along the lines 6—6 of FIG. 5 in the direction indicated by the arrows.

The FIG. 5 indicates a modified shaft **19*a*, wherein the shaft annular flange 21 is divided into first and second shaft flanges 33 and 34 arranged in a coextensive relationship relative to one another, having a clutching disc 35 separating the first and second shaft flanges to provide for the rotative relative motion of the shaft first end 20 relative to the shaft second end upon exceeding a predetermined torque level effected by the spring 26 projecting the first shaft flange 33 towards the second shaft flange 34. A shaft first end pilot shaft 36 is received within the pivot shaft receiving bore 37 through the clutching disc 35, in a manner as illustrated in FIGS. 5 and 6**.

Figure 7:
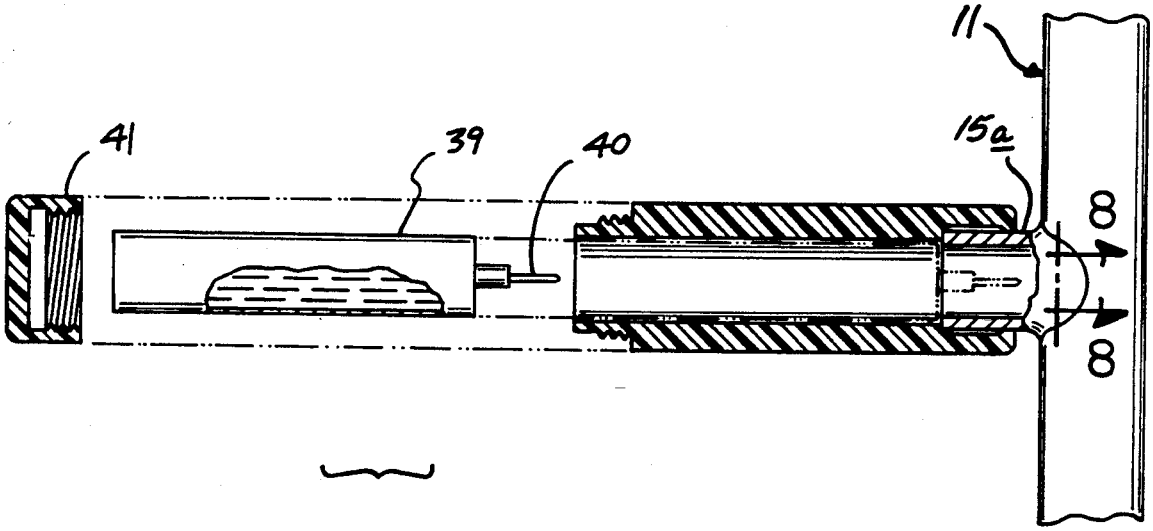
FIG. 7 is an orthographic exploded illustration indicating a modified handle including a lubricant reservoir.
Figure 8:
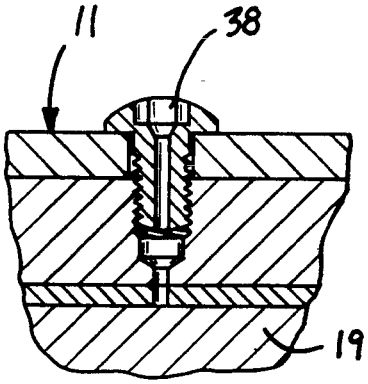
FIG. 8 is an enlarged orthographic cross-sectional illustration, taken along the lines 8—8 of FIG. 7 in the direction indicated by the arrows.

The FIGS. 7 and 8 indicates the use of a modified handle **15*a*, having a lubricant reservoir housing 39, including a projecting needle 40 for reception through a valve conduit 38 directed through the housing in communication with the shaft 19 to effect lubrication of the shaft. The reservoir housing 39 is maintained within the handle 11*a* by a handle cap 41. The handle cap is flexible as is the lubricant housing 39, whereupon imposing pressure onto the handle cap 41 effects pressurizing of the reservoir housing 39 to project fluid into the housing 11 through the valve conduit 38**.

In this manner, upon securement of the rotary drill assembly "D" to the shaft first end 20, simultaneous rotation and projection of the fastener from within the fastener receiving cavity 32 is available.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A screw driving extension apparatus, comprising, an elongate tubular housing, having a housing first end spaced from a housing second end, with the housing aligned about an axis, and a handle integrally mounted to the housing between the housing first end and the housing second end, and the housing first end including a first end cap, the first end cap including a first end cap bore, and a rotary shaft rotatably and reciprocatably mounted relative to the tubular housing, with the rotary shaft having a rotary shaft first end projecting through the first end cap bore, the cap having a cap annular flange in surrounding relationship relative to the first end cap bore, with the shaft having a shaft annular flange oriented adjacent the cap annular flange, and the shaft having a shaft second end, the shaft second end including a shaft second end socket, with the shaft second end socket including a longitudinal screw driving bit received therewithin, with the screw driving bit received within a fastener receiving cavity oriented between the shaft second end and the housing second end, and wherein the housing includes a fixed first bushing spaced from the shaft annular flange, and a reciprocatably mounted second annular bushing interposed between the shaft annular flange and the first bushing, and a spring, the spring positioned between the second annular bushing and the first annular bushing, with the spring arranged for compression permitting displacement of the shaft annular flange towards the first bushing.

2. An apparatus as set forth in claim 1 including a third annular bushing spaced from the first annular bushing within the tubular housing interposed between the shaft and the tubular housing, and a fourth bushing fixedly mounted within the housing and spaced from the third bushing, with a ferromagnetic collar mounted fixedly to the fourth annular bushing, with the screw driving bit recessed within the ferromagnetic collar when the shaft is in a first position, and the screw driving bit projecting beyond the ferromagnetic collar in a second position upon said displacement of the shaft annular flange towards the first bushing.

3. An apparatus as set forth in claim 2 wherein the shaft annular flange includes a first shaft flange rotatably mounted and spaced from a second shaft flange, with a clutching disc interposed between the first shaft flange and the second shaft flange, with the shaft first end having a shaft first end pilot shaft, and a pilot shaft receiving bore directed within the shaft receiving the pilot shaft through the clutching disc.

4. An apparatus as set forth in claim 3 wherein the housing includes a valve conduit positioned within the housing in alignment with the handle, and a lubricant flexible housing received within the handle, the lubricant housing having a projecting needle received through the valve conduit, and the valve conduit permitting pneumatic communication between the shaft and the flexible housing, and a flexible handle cap mounted to said handle, whereupon deformation of the handle cavity effects deformation of the flexible housing to direct lubricant through the valve conduit into communication with the shaft.

* * * * *